United States Patent [19]

Muller

[11] 4,266,520

[45] May 12, 1981

[54] FUEL-AIR MIXTURE ARRANGEMENT WITH AN AIR-COMPRESSING SUPER-CHARGER FOR A COMBUSTION ENGINE

[75] Inventor: Hans-Jurgen Muller, Gelsenkirchen, Fed. Rep. of Germany

[73] Assignee: Pierburg GmbH & Co. Kg, Neuss, Fed. Rep. of Germany

[21] Appl. No.: 37,700

[22] Filed: May 10, 1979

[30] Foreign Application Priority Data

Jul. 13, 1978 [DE] Fed. Rep. of Germany ..... 2830709

[51] Int. Cl.[3] ..... F02D 3/02; F02D 23/02

[52] U.S. Cl. ..... 123/454; 123/453; 123/463

[58] Field of Search ..... 123/140 MP, 139 AW, 123/139 BG, 119 C, 452, 453, 454, 455, 463, 383; 60/559, 564

[56] References Cited

U.S. PATENT DOCUMENTS

| | | | |
|---|---|---|---|
| 1,955,037 | 4/1934 | Uiel | 123/119 C |
| 2,324,599 | 7/1943 | Schorn | 123/119 C |
| 2,374,844 | 5/1945 | Stokes | 123/119 C |
| 2,997,034 | 8/1961 | Lee | 123/119 C |
| 3,487,820 | 1/1970 | Clark | 123/463 |
| 3,680,536 | 8/1972 | Clark | 123/453 |
| 3,929,114 | 12/1975 | Chattopadhayay | 123/452 |
| 3,930,481 | 1/1976 | Eckert | 123/452 |
| 3,983,856 | 10/1976 | Stumpp | 123/453 |
| 4,147,146 | 4/1979 | Wessel | 123/139 AW |

*Primary Examiner*—Charles J. Myhre
*Assistant Examiner*—Carl Stuart Miller
*Attorney, Agent, or Firm*—Haseltine and Lake

[57] ABSTRACT

A fuel-air mixture arrangement with an air-compressing supercharger for a combustion engine with continuous fuel injection into the intake pipe which holds an air quantity meter, a pivotal ram flap and a throttle flap are arranged behind each other. The air quantity meter, depending on its deflection, actuates a fuel metering unit. The fuel metering proceeds at constant pressure drop in the fuel. This pressure drop can be varied depending on certain coefficients, and the pressure drop on a valve is varied by a control pressure valve to which controlling variables are applied. The set pressure drop at the metering cross sections of the fuel metering units is kept constant by the valve operated by the control pressure valve. The air quantity meter is located downstream of the air compressing supercharger and the control pressure valve receives the supercharger air pressure prevailing upstream of the throttle flap via a diaphragm unit. The control pressure valve may be connected to a thermostat located in the supercharger air flow.

2 Claims, 1 Drawing Figure

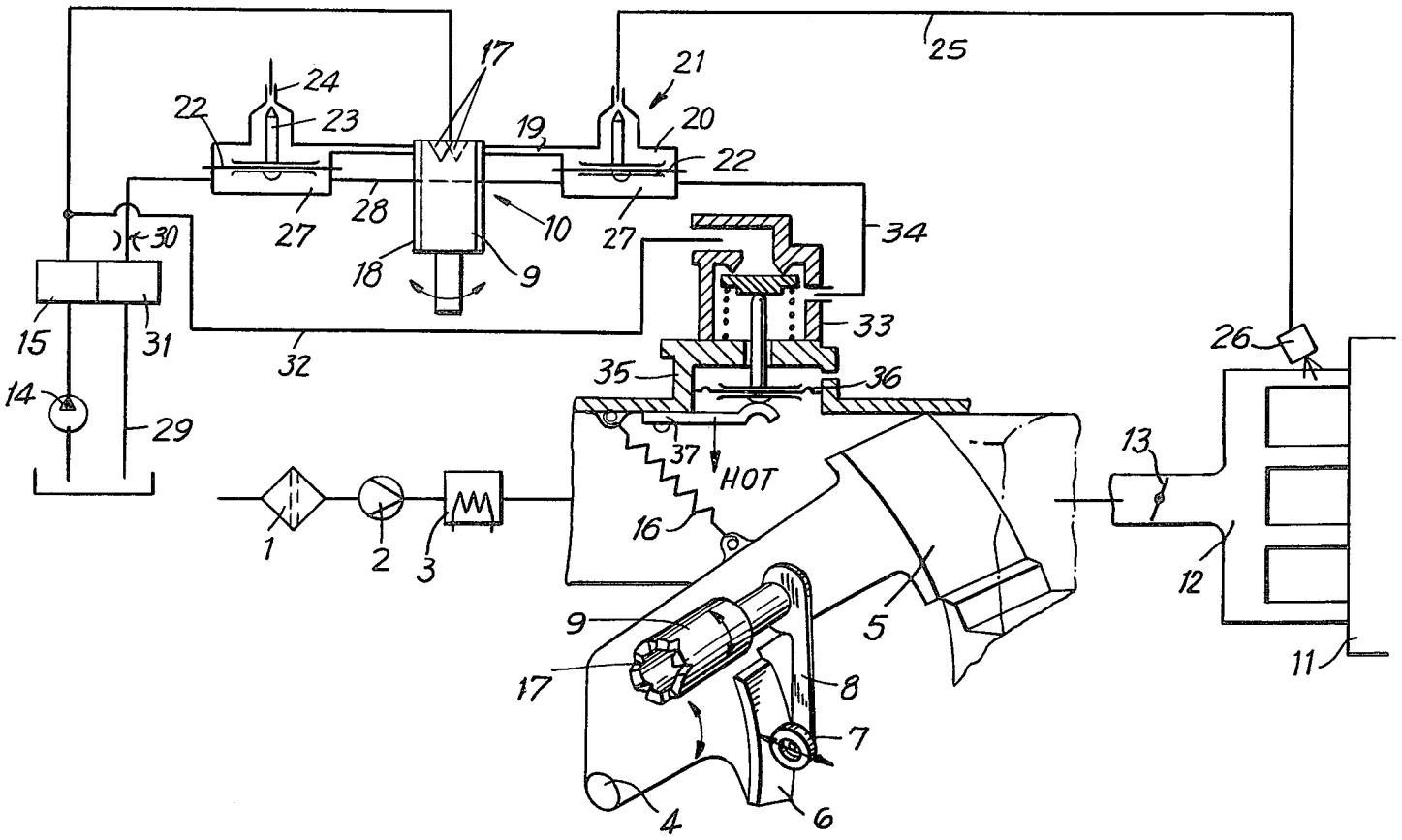
HOT

FUEL-AIR MIXTURE ARRANGEMENT WITH AN AIR-COMPRESSING SUPER-CHARGER FOR A COMBUSTION ENGINE

BACKGROUND OF THE INVENTION

The present invention relates to a fuel-air mixture arrangement with an air-compressing supercharger for a combustion engine with continuous fuel injection into the intake pipe which holds an air quantity meter, consisting of a pivotal ram flap and a throttle flap arranged behind each other. The air meter, depending on its deflection, actuates a fuel metering unit, fuel metering taking place at constant pressure drop in the fuel; this pressure drop is, however, variable depending on certain coefficients. The pressure drop on a second valve is variable by means of a control pressure valve to which the controlling variables are applied. This second valve keeps the set pressure drop at the cross sections of the fuel metering unit constant.

Such an arrangement is known from German Patent No. 23 40 834 and from German Laid-Open Document 25 57 968.

It is known to place such an air measuring device upstream of an air-compressing supercharger, for example, an exhaust gas turbosupercharger. However, this has the disadvantage that the path between ram flap and throttle flap is very long. Since the position of the ram flap simultaneously controls the fuel quantity, during a change of the throttle flap position the dead time of the controlled system is so large that the mixture composition is not correct and thus short-timed operating errors occur.

Accordingly, it is an object of the present invention to provide a fuel-air mixture forming arrangement which in the operation with an air compressing supercharger avoids the dead time of the controlled system.

Another object of the present invention is to provide an arrangement of the foregoing character which is substantially simple in construction and may be economically fabricated.

A further object of the present invention is to provide a fuel-air mixture forming arrangement, as described, which may be readily maintained in service and which has a substantially long operating life.

SUMMARY OF THE INVENTION

These objects of the present invention are achieved by placing the air quantity meter downstream of the air-compressing supercharger and having the control pressure valve receive charging air pressure prevailing upstream of the throttle flap via a diaphragm unit. For temperature compensation for the charging air flow, the control pressure valve is connected to a thermostat.

However, if a combustion engine is operated with a supercharger, for example, with an exhaust gas turbosupercharger, this arrangement is not capable of keeping the ratio of air to fuel constant during the charging operation, since the metering cross sections of the fuel metering unit are controlled by the displacement of the pivotal ram flap. Since the ram flap measures volume flow and this volume flow with the compressed medium air is less than the volume flow at standard conditions (20° C., 1 bar) for the same air mass flow, the displacement of the ram flap is smaller. Hence not enough fuel is metered. To solve this problem, an additional improvement of the present invention is required. Temperature compensation is useful since the charge air cooler is not able to always cool the air to the same temperature when the supercharger supplies air of varying initial temperature.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

A schematic view showing the essential elements and their interrelationships of an embodiment, in accordance with the present invention.

BRIEF DESCRIPTION OF THE PREFERRED EMBODIMENTS

The sucked-in air travels to a compressing supercharger 2 via an air filter 1. This supercharger may be a known exhaust gas turbosupercharger. From there it travels to a conventional charging air cooler 3. The supercharger 2 starts to operate at a certain motor speed.

Downstream of these devices is a known air quantity measuring device with a ram flap 5 pivoting about an axis 4. This ram flap, through a curved track 6 attached to it and a scan roller 7 cooperating with it, actuates a lever 8. This lever actuates the control piston 9 of a fuel metering unit 10 whose function will be described later in detail in connection with the fuel supply of motor 11.

The ram flap 5 moves against the force of a spring 16 according to the volume flow determined by the difference in air pressures prevailing in the immediate upstream and downstream vicinity. Downstream of this ram flap 5, a throttle flap 13 is arranged in the intake pipe 12. Via a system pressure valve 15, a fuel pump 14 delivers fuel to the fuel metering unit 10. This valve 15 keeps the pressure of the supplied fuel constant.

In the fuel metering unit, the fuel is metered by rotating the control piston 9 according to the position of the ram flap 5 via overlapping triangular slots. On the front side, the piston 9 has a number of slots 17 depending on the number of cylinders of engine 11. The sleeve 18 receiving this piston has corresponding exit slots which discharge into a duct 19 which is connected to a chamber 20 of a valve 21. This chamber 20 has an outlet 24 whose cross section is regulated by means of a pin 23 fastened to a diaphragm 22. This outlet is connected via a line 25 with an injector valve 26 arranged before the intake of each cylinder and continuously supplying fuel. Chamber 27 of valve 21, which chamber is located opposite the outlet 24, is under control pressure.

The individual chambers 27 of valves 21, depending on the number of cylinders, are connected via a duct 28 and have a common return to tank via a fixed throttle 30, determining the return quantity, and a pressure maintenance valve 31 preventing the arrangement from running dry when standing still. The chambers 27 are supplied control pressure. For this purpose, a control pressure valve 33 is supplied fuel under system pressure via a line 32. This system pressure is reduced by a constant amount which can be adjusted depending on the outside conditions, and via line 34 is fed to the interconnected chambers 27 as control pressure. By changing this control pressure, the pressure drop in the fuel is changed via the triangular slots located in piston 9 and sleeve 18, since a pressure balance appears between chambers 20 and 27.

Thus with the same position of piston 9 and hence of the ram flap 5, a variable fuel flow via these metering cross sections results depending on the change in control pressure.

With non-supercharged engines, such changes are known on such injection devices, for example, as a function of cooling water temperature (German Patent No. 23 40 834).

The control pressure valve 33, via a diaphragm unit 35, receives supercharger air pressure prevailing upstream of the throttle flap 13, preferably supercharger air pressure upstream of ram flap 5. This means, that the desired constant ratio of changing air mass to changing fuel mass can be expressed by stating that the change of supercharger air pressure in relation to the fuel pressure is constant across the metering cross section and also directly proportional. It is anticipated that a thermostatic element, for example, a bimetallic spring 37 upon heating the supercharge air, which amounts to a volume increase, acts on diaphragm 36 or unit 35 so as to reduce the metered fuel quantity.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A fuel-air mixture arrangement for a combustion engine, comprising: an intake pipe with continuous injection; an air-compressing supercharger; an air quantity meter located in said intake pipe said air quantity meter comprising a ram flap, a throttle flap arranged behind said ram flap; a fuel metering unit actuated by said air quantity meter, fuel metering proceeding at constant pressure drop in the fuel, said constant pressure drop being variable depending on predetermined parameters; a control pressure valve for providing control-pressure circulation for the fuel; an auxiliary valve having a pressure drop varied by means of said control pressure valve for controlling variables being applied to said control pressure valve; said fuel metering unit having metering cross sections, said auxiliary valve keeping a set constant pressure drop at said metering cross sections constant, said air quantity meter being located downstream of said air-compressing supercharger; a diaphragm unit; said control pressure valve being fed super-charger air pressure prevailing upstream of said throttle flap by said diaphragm unit.

2. An arrangement as defined in claim 1 including a thermostat exposed to supercharger air flow and connected to said control pressure valve.

* * * * *